United States Patent [19]

Schuurmans

[11] Patent Number: 4,706,585

[45] Date of Patent: Nov. 17, 1987

[54] MAKING BELT LOOPS AND ATTACHING THEM TO ARTICLES OF CLOTHING

[75] Inventor: Marinus E. Schuurmans, Waalwijk, Netherlands

[73] Assignee: USM Corporation, Farmington, Conn.

[21] Appl. No.: 899,370

[22] PCT Filed: Nov. 5, 1985

[86] PCT No.: PCT/GB85/00502

§ 371 Date: Jul. 3, 1986

§ 102(e) Date: Jul. 3, 1986

[87] PCT Pub. No.: WO86/02810

PCT Pub. Date: May 22, 1986

[30] Foreign Application Priority Data

Nov. 5, 1984 [NL] Netherlands ..... 8403360

[51] Int. Cl.[4] ..... D05B 23/00; D05B 3/12; D05B 35/10

[52] U.S. Cl. ..... 112/121.27; 112/152; 112/104; 112/265.1

[58] Field of Search ..... 112/121.27, 121.26, 112/152, 153, 104, 217, 265.1

[56] References Cited

U.S. PATENT DOCUMENTS

| | | | |
|---|---|---|---|
| 2,821,385 | 1/1958 | Hoffce | 112/121.27 X |
| 3,320,926 | 5/1967 | Dexter et al. . | |
| 3,562,817 | 2/1971 | Hunter et al. | 112/121.27 X |
| 3,699,907 | 10/1972 | Anderson et al. | 112/121.27 |
| 3,752,099 | 8/1973 | Hunter et al. | 112/121.27 |

FOREIGN PATENT DOCUMENTS

| | | |
|---|---|---|
| 86311 | 12/1965 | France . |
| 2101874 | 3/1972 | France . |
| 2362235 | 3/1978 | France . |

*Primary Examiner*—H. Hampton Hunter

*Attorney, Agent, or Firm*—Thomas S. Szatkowski

[57] ABSTRACT

Method of attaching belt loops (L) to articles of clothing (6), e.g. trousers and skirts, comprises feeding a strip of material (M) through a cutting station (C) at which it is cut into lengths (L) and securing those lengths in position by stitching. Prior to cutting, adhesive is applied to the strip (M) at either sides of each cutting location so that each end of each length has a coating of adhesive. The adhesive, which is applied to both sides of the strip, is to prevent fraying.

7 Claims, 4 Drawing Figures

MAKING BELT LOOPS AND ATTACHING THEM TO ARTICLES OF CLOTHING

FIELD OF INVENTION

This invention is concerned with a method of making belt loops and subsequently attaching them to articles of clothing, comprising the steps of cutting lengths of textile material from a strip thereof and sewing each such length to an article of clothing, the arrangement being such that, in the finished article, the ends of each length are each folded over and sewn directly to the article, wherein the ends of each length are provided with a coating of a fray-prevention binding medium prior to being sewn, and apparatus for carrying out such method.

BACKGROUND OF THE INVENTION

There is disclosed in GB-A No. 1338706 a belt loop for attachment to an article of clothing, which belt loop has, at opposite ends thereof, a coating of a fray-prevention binding medium.

In manufacturing such belt loops, the loops are first cut from a strip or length of material and then the adhesive material (or binding medium) is sprayed or applied by an applicator to the ends of the loops, or alternatively the ends are dipped into the adhesive for the desired extent or penetration. Although not specifically referred to in said specification, it has been conventional for many years to secure belt loops to articles of clothing by sewing, and indeed more specifically by a method generally as set out in the preceding paragraph.

It will be appreciated that such a method of applying the binding medium requires individual handling of the separate loops, which, if carried out by hand, is tedious and time-consuming or, if carried out by machine, requires relatively complicated handling apparatus. Furthermore, since the adhesive has then to be dried prior to attaching to the article of clothing, further handling steps, and possibly storage for a short period, are required.

Thus, the method set out in GB-A No. 1338706 does not readily lend itself to a production line, still less to an automatic production of garments.

It is proposed in FR-A No. 2329787 to apply locally, e.g. by a screen printing technique, a binding medium to sheet material, e.g. textile material, prior to cutting into garment components, with a view to the binding medium subsequently preventing fraying of the edges of such cut components. In this case, however, the cut edge portions are not to be exposed in the finished garment (bearing in mind that the edge treatment is intended merely to replace a conventional overlocking of otherwise raw edges), so that from the point of view of the appearance of the edge portions in the finished garment it would not be considered important to ensure that no loose thread whatsoever could arise. Consequently for example it was considered adequate to apply the binding medium only to one side of the material.

By comparison, belt loops are clearly visible in the finished garment, so that even a small number of loose threads will not be acceptable. Furthermore the effectiveness of the fray-prevention should last for an extended period, viz. throughout the life of the garment, even when subjected to repeated washing.

OBJECTS OF THE INVENTION

It is thus one of the objects of the present invention to provide a method of making belt loops and attaching them to articles of clothing, which method, while on the one hand enhancing the appearance of the finished garment and preventing any unsightly fraying of the belt loops thereof, also on the other hand lends itself to automated production line manufacture.

It is another of the objects of the present invention to provide an improved apparatus suitable for use in carrying out a method in accordance with the invention, which apparatus facilitates automated production.

BRIEF STATEMENT OF THE INVENTION

The first of the above objects is resolved in accordance with the invention, in a method as set out in the first paragraph above, in that, prior to cutting the lengths from the strip material, the binding medium is applied to both sides of the strip material in the form of stripes which extend transversely of the strip material and are spaced apart by a distance corresponding to the length to be cut, and in that cutting takes place transversely of the strip material substantially centrally of the stripes so that the thus cut portions of each stripe provide a coating for opposite ends of adjacent cut lengths of the strip material. It will be appreciated that, by applying the binding medium before cutting, a through-feed of the length of material can be achieved and, in a single handling operation, the cut portion can be transferred automatically under control to a sewing station, thereby eliminating any intermediate handling by an operator. Furthermore, by applying the adhesive to both sides of the strip, the cut fibres of the material are more securely entrapped in the binding medium, thereby reducing any risk of fraying or of loose ends creating an unsightly appearance in the finished article of clothing.

In carrying out the method, especially when applied in an automated production line, it is desirable that the binding medium dries quickly, more particularly before the coated fabric reaches the cutting station without any undue delay and to this end preferably the binding medium is a thermoplastic composition, e.g. a polyethylene resin adhesive composition.

Further in carrying out the method in accordance with the invention, conveniently the stripes are applied by means of heated nozzles arranged at opposite sides of the strip of material. In addition, for using the binding material efficiently, i.e. to achieve the desired effect with a minimum amount of adhesive, it has been found effective first to supply a controlled quantity of the binding medium to the opening of each nozzle and thereafter to bring the nozzles into contact with the surface of the strip material. In carrying out a preferred method the nozzles are heated to a temperature of about 200° C. and are pressed against the surface of the strip material for a period of 1.5 to 2 seconds. Furthermore, preferably adhesive is supplied to each nozzle for a controlled time of 0.1 to 0.3 seconds.

In accordance with the invention, furthermore, for use in carrying out the method in accordance with the invention apparatus is provided, comprising a sewing machine having stitch forming instrumentalities, including a reciprocable needle, arranged at a sewing locality of the apparatus, advancing means by which a strip of material is advanced step-by-step from a supply thereof through a cutting station, at which a cutting tool is provided for cutting the strip material into lengths, such cutting taking place transversely of the direction of advance of the strip material, and transfer means for transferring cut lengths of the strip material to the sewing locality of the sewing machine, wherein adjusting means is provided for setting the distance through which the strip material is advanced in each operating step of the advancing means, characterised in that an applicator station is arranged between the advancing means and said supply, at which station two applicators are provided, one at each side of a strip of material being advanced by the advancing means, for applying stripes of a binding medium to opposite sides of the strip material such that the stripes extend transversely of the strip material, and in that means is provided for positioning the applicators spaced from the cutting station by a distance determined according to the distance through which the strip material is advanced as aforesaid, so that cutting takes place in the region of the strip material to which binding medium has previously been applied.

It will be appreciated that, using such an apparatus, a wholly automated material handling system from the supply of material to the sewing station can be achieved. Furthermore, as in conventional in sewing operations, the ends of each length of material can be automatically folded over prior to sewing.

Preferably in the apparatus in accordance with the invention control means is provided whereby, after the material has been advanced by the advancing means as aforesaid, the cutting tool is caused to operate to cut a length of material, which cut length is then transferred by the transfer means to the sewing station, the arrangement being such that, prior to the operation of the cutting tool, the applicators are caused to operate to apply adhesive to the strip material. Conveniently each applicator comprises a nozzle and means for pressing the nozzles against the strip material, and the control means comprises a first timer, by which the operation of a control valve for controlling the supply of binding medium to the applicators is controlled, and further which, on timing out, causes a second timer to be actuated, by which the period during which the nozzles are pressed against the strip material is controlled.

Furthermore, for ensuring that the material is adequately controlled without operator intervention during the application of the binding medium, conveniently a guide plate is provided at the applicator station for supporting the strip of material in the vicinity of the nozzles, and a presser foot is also provided for pressing the strip of material against the guide plate as the nozzles are moved out of contact with the strip material.

DESCRIPTION OF THE DRAWINGS

There now follows a detailed description, to be read with reference to the accompanying drawings, of a method of making belt loops and subsequently attaching them to articles of clothing, together with an apparatus for carrying out such method. It will of course be appreciated that this apparatus and method have been selected for description merely by way of non-limiting example.

In the accompanying drawings.

DESCRIPTION OF THE PREFERRED EMBODIMENTS

The apparatus in accordance with the invention which is now to be described is based upon a conventional commercially available automatic sewing machine, namely the Juki Model MOL-122P automatic sewing machine. It will of course be appreciated that any suitable commercially available machine may be so used. In particular, the Juki Model MOL-122P is a computer-controlled machine, but the invention is equally applicable to a mechanically controlled machine.

Figure 1:
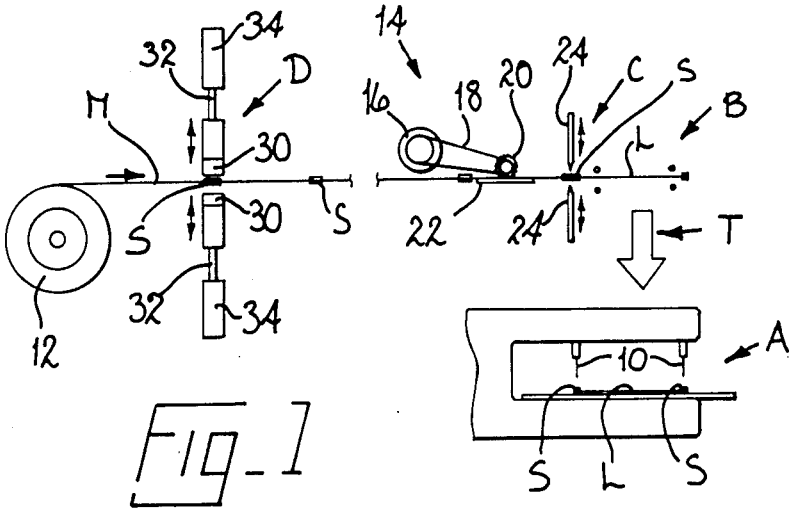
FIG. 1 is a diagrammatic representation of apparatus in accordance with the invention for making belt loops and subsequently securing them to articles of clothing.

The Juki Model MOL-122P machine is specifically configured for attaching belt loops L to articles of clothing G and comprises a sewing station A (see FIG. 1) having stitch forming instrumentalities including two reciprocating needles 10 which operate simultaneously to secure opposite, folded over, ends to an article of clothing in a single operating cycle. "Upstream" of the sewing station B is a folding and transfer station B and beyond that (i.e. further "upstream") is a cutting station C. In the operation of the machine, material M in strip form is supplied from a roll 12 thereof to the cutting station C, at which individual lengths from which belt loops L will be formed are cut and advanced to the folding and transfer station B for transfer by transfer means (indicated by arrow T in FIG. 1) to the sewing station A.

The machine also comprises advancing means generally designated 14 arranged just "upstream" of the cutting station C. The advancing means is arranged to operate intermittently to feed the strip material M step-by-step, and indeed through a controlled distance equivalent to the desired length of the belt loops L. To this end, the advancing means comprises a stepping motor 16 having a chain drive connection 18 to a toothed feed roll 20 which engages an upper surface of the material M. Beneath the material M, and opposite the roll 20, is a flat low-friction plate 22 against which the material is pressed by the feed roll 20. Computer-control means (not shown) is provided for signalling the stepping motor 16 in order closely to control the feed length of the material. The control means also comprises a control panel (also not shown) operable by the operator.

The advancing means 14, cutting station C and folding and transfer station B are so arranged that the advancing means feeds the leading end of the material M into the folding and transfer station B, the length being determined as aforesaid, prior to the leading end portion being cut off to form the belt loop L. For cutting the leading end portion, furthermore, a pair of reciprocating blades 24 is provided at the cutting station C and operates to cut the strip material M transversely of the direction of feed. Of course, any other suitable cutting mechanism could be utilised instead of such blades.

After the cutting operation has taken place, opposite ends of each belt loop L are folded over automatically and the belt loop is then transferred automatically to the sewing station A, at which the operator will have positioned the article of clothing G for the stitching operation to take place.

Figure 2:
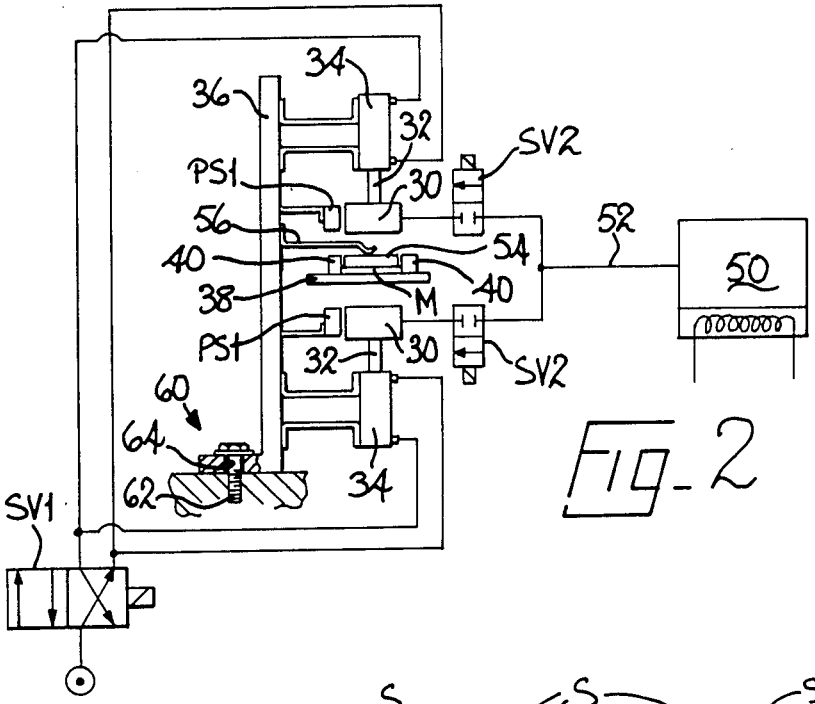
FIG. 2 is a fragmentary schematic view, showing details of an applicator station of said apparatus.
Figure 3:
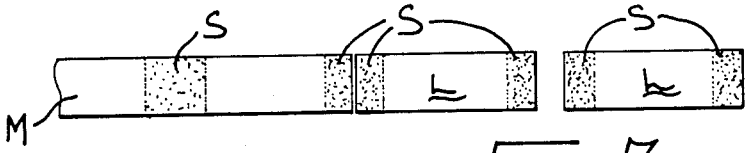
FIG. 3 is a fragmentary plan view of a strip of material at various stages in its treatment as it passes through said apparatus.

In the machine of the above type, in accordance with the present invention a further, applicator, station D is provided between the roll supply of material M and the advancing means 14. Viewing FIG. 2, the applicator station D comprises two nozzles 30 each of which is supported on a piston rod 32 of a piston-and-cylinder arrangement 34, each such arrangement 34 being secured tc, an upstanding frame portion of the apparatus. The nozzles 30 are arranged one above and one below the path of movement of the material M, which, at the applicator station D, passes over a support plate 38 and between upstanding guides 40 provided on said support plate 38.

The arrangements 34 are pneumatically operated, are double-acting, and are controlled by means of a solenoid valve SV1, operation of which is computer-controlled, as will be described hereinafter. In addition, there is associated with each nozzle 30 a proximity switch PS1, which detects when the nozzles are in a retracted position. The function of the proximity switches will also be described hereinafter.

The nozzles are used for applying a binding medium to opposite sides of the material M as it is fed intermittently through the applicator station D. The binding medium, which preferably is of the hot melt type, as will be described in detail later, is applied from a melt chamber 50 through heated hoses 52 to the nozzles 30. For controlling the flow of binding medium to the nozzles, furthermore, each hose has incorporated therein a solenoid-operated on-off valve SV2.

In the operation of the apparatus in accordance with the invention, the nozzles 30 are brought into contact with the surface of the strip material M at the applicator station B between each operation of the advancing means 14. To this end, the support plate 38 has a cut-out therein to allow passage of the nozzle into such surface contact. Furthermore, in order to prevent the strip material from being lifted from the support plate 38 when the nozzle 30 thereabove is being retracted, a presser member 54, urged downwardly by a spring 56, is provided for holding the material M against the support plate 38.

The distance through which the material is advanced in one advancing step can be set by the operator, through the control means. Means generally designated 60 is also provided for setting the distance by which the applicator station D is spaced from the cutting station C in relation to the distance of advance; more particularly, the distance between the central plane of the nozzles extending transversely of the path of advancing movement of the material M and the blade 24 at the cutting station C should be a multiple of the distance by which the material is advanced in each advancing step. Said means 60 thus comprises clamp screws 62 (one only shown in FIG. 2) accommodated in slots 64 in the frame portion 36 and extending parallel to the direction of advance of the strip material, for facilitating sliding adjustment movement of said frame portion. In addition, a suitable scale (not shown) is provided at the applicator station D for facilitating correct setting of the frame portion 36 so as properly to set the position of the nozzles in relation to the cutting station C.

The apparatus in accordance with the invention also comprises two timers (not shown, but referred to as T1, T2), of which the first (T1) controls the operation of the solenoid valves SV2, and thus the flow of binding medium to the nozzles 30, while the other timer (T2) controls the operation of solenoid valve SV1, and thus the amount of time the nozzles are held in contact with the surface of the material M, and also the timing of such operation.

Figure 4:
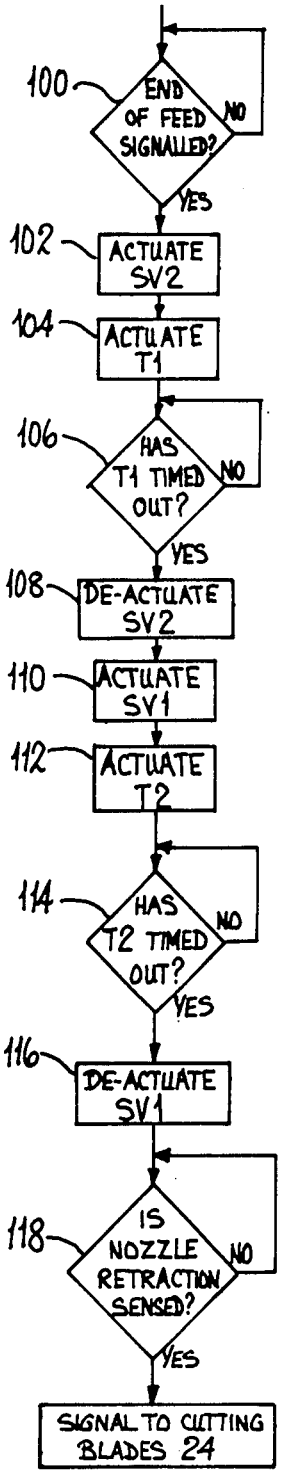
FIG. 4 is a flow chart representing a program for controlling the operation of the applicator station.

In the operation of the Juki Model MOL-122P machine, at the end of each advancing step a signal is supplied actuating the cutting blade 24, whereafter folding and transfer of the cut belt loop L takes place. In the apparatus according to the invention, this signal is utilised for initiating operation of the applicator station D, as will now be described with reference to FIG. 4. From FIG. 4 it is clear that at step 100 the signal is awaited and, in response to the signal being supplied, solenoid valves SV2 are opened to allow flow of binding medium to the nozzles 30 (step 102). At the same time, timer T1 is actuated (step 104), which timer, on timing out (monitored at step 106), causes solenoid valves SV2 to close (step 108) and operates solenoid valve SV1 (step 110) to cause the nozzles to be advanced into surface contact with and pressed against the material M. At the same time, timer T2 is actuated (step 112). At step 114 the timing out of timer T2 is monitored and, upon such timing out, solenoid valve SV1 is reversed (step 116) and thus the nozzles are caused to be retracted. At step 118 the proximity switches PS1 are monitored and, in response to both the nozzles 30 reaching their retracted positions, a signal is emitted (step 120) to the cutting mechanism; that is to say, the signal emitted at step 120 replaces the "start cut" signal in the operation of the unmodified Juki machine (referred to at step 100).

It will be appreciated that, in the operation of the apparatus in accordance with the invention, binding medium is supplied to the nozzles prior to their being brought into contact with the surface of the material M. This has been found to be most advantageous in reducing by a significant factor the amount of binding medium required for each application.

The method in accordance with the invention now to be described is for making belt loops and attaching them to articles of clothing, using the apparatus in accordance with the invention as just described. In carrying out said method, the binding medium used is a thermoplastic adhesive, identified as Bostik 9602 ("Bostik" is a registered trade mark), more particularly an adhesive in granular form, which is a blend of polyethylene, hydrocarbon resin and ethylene/ethylacrylate copolymer.

For applying this adhesive composition, the granular material is fed into the melt chamber 50 from which it can be pumped along the hoses 52 to the nozzles 30. For maintaining the composition at the desired viscosity, the hoses are heated to 240° C. and the nozzles are maintained at a temperature in the region of 200° C. In applying the adhesive, furthermore, it has been found that, by supplying a controlled amount of adhesive is supplied to the nozzles 30 prior to bringing the nozzles into surface contact with the material M, a significant saving in the amount used can be achieved. Consequently, timer T1 is set to maintain solenoid valves SV2 open for a period of between 0.1 and 0.3 seconds only, according to the amount of adhesive required. It will of course be appreciated that maintaining the nozzles at a temperature in the region of 200° C. would be likely to cause damage to the strip material M if the nozzles are held in surface contact for an extended period. Consequently, timer T2 is set for a period of between 1.5 and 2 seconds. It has been found that no risk of scorching arises over such a short period, while the adhesive composition is maintained sufficiently fluid for it to penetrate into the threads of the material from both sides.

The application of adhesive composition takes place, as above described, immediately following termination of the advancing step and prior to the cutting operation being initiated. In another apparatus in accordance with the invention, on the other hand, it would be possible for cutting to take place simultaneously with the application of adhesive composition.

In carrying out the method in accordance with the invention the adhesive is applied to the material in the form of stripes S extending transversely of the strip material M, which stripes are spaced apart from one another by a distance corresponding to the length of the belt loop L, the arrangement being such that, by spacing the longitudinal transverse central plane of the nozzles 30 by such distance from the cutting blade 24 at the cutting station C, cutting takes place transversely of the strip material and substantially centrally of each transversely applied adhesive stripe S so that at each end of each belt loop L, and at both sides thereof, is provided a coating of the binding medium. It has been found satisfactory, when using the Bostik 9602 composition, to space the nozzles from the cutting station C by a distance equal to five times the length of the belt loop L, and in such circumstances no forced drying of the adhesive is required. Of course, if a shorter distance is necessary (e.g. for space reasons), then some forced drying could be used to accelerate drying.

It has been found that, in using the apparatus in accordance with the invention, the need for trimming loose threads from the ends of belt loops has been essentially eliminated, by the new automatic process of applying adhesive or other binding medium, automatically without any significant interruption of production flow, to the strip material M, at those localities thereof where cutting is subsequently to take place.

What is claimed is:

1. In an apparatus for making belt loops from a strip of material which apparatus comprises supply means for continuously feeding a strip of material, advancing means for advancing said strip of material step-by-step from said supply to a cutting operation, cutting means for cutting said strip of material into lengths transversely of the direction of advance of the strip material, transfer means for transferring cut lengths of said strip of material to a sewing operation, and sewing means for sewing said strips of material into belt loops;

the improvement which comprise:

an adhesive applicator positioned between said supply means and said advancing means, said applicator comprising two heated nozzles, positioned one on each side of said strip of material, pressing means for pressing said nozzles against the surface of the strip material and control means for operating said nozzles and pressing means such that adhesive is applied on both sides of said stripes of material in transverse stripes, said stripes being spaced apart from one another by a distance corresponding to the length of the belt loop.

2. The improvement of claim 1 further comprising a guide plate for supporting said strip of material in the vicinity of the nozzles and a presser foot for pressing said strip of material against said guide plate as the nozzles are moved out of contact with said strip of material.

3. The improvement of claim 1 wherein said pressing means comprises a pneumatic piston and cylinder.

4. The improvement of claim 1 further comprising adjusting means for spacing said adhesive applicator in relation to said cutting means.

5. The improvement of claim 1 wherein said control means comprises timers for measuring the length of time said nozzles are in contact with the surface of said strip of material.

6. The improvement of claim 1 further comprising solenoid valves to limit the flow of adhesive to said nozzles.

7. The improvement of claim 1 wherein said control means comprises timers for measuring the length of time adhesive is supplied to said nozzles.

* * * * *